US006879662B2

(12) United States Patent
Blin et al.

(10) Patent No.: US 6,879,662 B2
(45) Date of Patent: Apr. 12, 2005

(54) RADIATION EMISSION DEVICE AND METHOD

(75) Inventors: Philippe Blin, Maurepas (FR); Xavier Le Pennec, Trappes (FR); Frédéric Dahan, Le Chesnay (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 93 days.

(21) Appl. No.: 10/218,827

(22) Filed: Aug. 14, 2002

(65) Prior Publication Data

US 2003/0043966 A1 Mar. 6, 2003

(30) Foreign Application Priority Data

Sep. 3, 2001 (FR) ..... 01 11383

(51) Int. Cl.[7] ..... H01J 35/30
(52) U.S. Cl. ..... 378/137; 378/207
(58) Field of Search ..... 378/137, 113, 378/207

(56) References Cited

U.S. PATENT DOCUMENTS 4,675,891 A 6/1987 Plessis et al. ..... 378/132
4,819,260 A 4/1989 Haberrecker ..... 378/137
5,581,591 A * 12/1996 Burke et al. ..... 378/135

FOREIGN PATENT DOCUMENTS

| | | |
|---|---|---|
| EP | 0144272 | 6/1985 |
| EP | 0972490 | 1/2000 |
| EP | 1087419 | 3/2001 |
| FR | 2518805 | 6/1983 |
| FR | 2566987 | 1/1998 |

OTHER PUBLICATIONS

DAT. Abstracts of Japan, vol. 017, No. 125 (E–1332), Mar. 16, 1993.

* cited by examiner

*Primary Examiner*—Craig E. Church
(74) *Attorney, Agent, or Firm*—Cantor Colburn LLP

(57) ABSTRACT

An X-ray emission device and method for a radiology apparatus comprises a cathode and a rotating anode, the anode being provided with a roughly cylindrical surface. The device forms a beam of electrons that bombards a portion of the roughly cylindrical surface of the anode that constitutes the focal point of emission of the X-rays. The position of the focal point of the anode relative to a reference position is dynamically controlled.

16 Claims, 3 Drawing Sheets

RADIATION EMISSION DEVICE AND METHOD

CROSS-REFERENCE TO RELATED APPLICATIONS

This application claims the benefit of a priority under 35 USC 119 to French Patent Application No. 01 11383 filed Sep. 3, 2001 the entire contents of which are hereby incorporated by reference.

BACKGROUND OF THE INVENTION

The present invention concerns a radiation emission device, for example, an X-ray emission device, which can be used, for example, in the field of medical imaging. A radiography apparatus, used for mammography, for example, comprises an X-ray tube and a collimator for forming and delimiting an X-ray beam, an image receiver. A positioner, bearing the assembly, comprises the X-ray tube and the image receiver, the assembly being movable in space on one or more axes. EP-A-972 490 discloses such an apparatus.

As is standard, for the purpose of screening for possible breast cancers, X-rays of the breast are taken to obtain images that are analyzed in order to deduce the likelihood of presence of a malignant lesion. The lesions are generally accompanied by microcalcifications, which can be detected on a radiographic image. However, those microcalcifications are of reduced size. It is therefore necessary to be able to obtain radiographic images with high resolution.

An X-ray tube, mounted, for example, in a medical radiology apparatus, comprises a cathode and an anode, both contained in a vacuum-tight envelope, in order to form an electric insulation between those two electrodes. The cathode produces a beam of electrons that is received by the anode on a small surface constituting a focal point whence the X-rays are emitted. On application of a high voltage by a generator at the terminals of the cathode and anode, a so-called "anode" current is established in the circuit across the generator producing the high voltage. The anode current crosses the space between the cathode and the anode in the form of the beam of electrons bombarding the focal point.

In order to obtain a high-energy beam of electrons, the electrons are accelerated by the intense electric field between the cathode and the anode. For that purpose, the anode is brought to a very high positive potential relative to the cathode. The potential ranges are approximately between 10 and 50 kV and can exceed 150 kV in some cases. To produce these potentials, high-voltage devices are used.

When the beam of electrons reaches the anode, the X-rays are emitted by the anode. Only a small percentage of the energy brought by the electrons is converted into X-rays, the rest of the energy being converted into heat. In order to avoid too great a temperature rise of the focal point, the focal point is formed on a surface of revolution of the anode, and the anode is turned about an axis of rotation. The portion of the surface of revolution of the anode forming the focal point, situated opposite the stationary cathode, is permanently displaced on the surface of revolution of the anode, making possible a distribution of heat on the entire surface of revolution of the anode.

To obtain a radiographic image possessing a high resolution, it is necessary to obtain an X-ray source of reduced dimensions. In other words, the focal point must be small. The cathode is designed to obtain a beam of electrons converging on a small surface of the anode forming the focal point. However, in use of the X-ray tube, the focal point is shifted from an initial position.

This displacement is due in part to the geometric defects of the anode. On high-speed rotation of the anode, the distance between the cathode and the portion of the anode forming the target where the focal point is formed is not constant. Furthermore, the increase in temperature of the X-ray tube produces expansion of the different components of the X-ray tube, an expansion that can cause the appearance of additional vibrations and the deformation of some of the elements producing a variation of distance between the cathode and the surface of the anode forming the focal point. The position defect of the focal point produces a widening of the apparent X-ray source or loss of space resolution of the focal point, thus diminishing the resolution of a radiographic image that can be obtained. A loss of space resolution limits the resolution of a film obtained from the X-ray source, and renders the detection of microcalcifications of small dimensions more difficult.

U.S. Pat. No. 4,675,891 describes an X-ray tube comprising a truncated cone-shaped anode placed in rotation on a shaft connected to a frame by means of magnetic bearings. The roughly truncated cone-shaped anode possesses a truncated cone-shaped surface of revolution having a narrow angle with a radial plane. A cathode is placed axially opposite the surface of revolution, the focal point being formed on the surface of revolution. The X-rays are emitted roughly radially. The use of magnetic roller bearings makes it possible, in combination with a focal point position detector, to correct the longitudinal position of the anode in order to maintain the position of the initial focal point.

Nevertheless, to be able to obtain a longitudinal movement of the anode, such a device requires the use solely of magnetic bearings connecting the shaft supporting the anode to the frame. Furthermore, the device does not make it possible to correct the position of the focal point radially.

BREIF DESCRIPTION OF THE INVENTION

The present invention a radiation emission device, for example, for X-ray emission, and method, that improves the resolution of a radiographic image obtained by means of the device. The invention is also directed to an X-ray emission device that can be obtained at low cost.

A radiation emission device and method according to one embodiment, intended for a radiology apparatus, comprises a cathode and a rotating anode, the anode being provided with a roughly cylindrical surface. The device is capable of forming a beam of electrons that bombards a portion of the roughly cylindrical surface of the anode that constitutes the focal point of emission of the X-rays. The device and method contains means for dynamically controlling the position of the focal point of the anode relative to a reference position.

An embodiment of the invention is also directed to a computer program capable of being loaded on a memory of a microprocessor including program code means making possible the use of an X-ray emission device intended for a radiology apparatus, when it is executed by a microprocessor, the X-ray emission device comprising a cathode and a rotating anode, the anode being provided with a roughly cylindrical surface and the device being capable of forming a beam of electrons that bombard a portion of the roughly cylindrical surface of the anode constituting the X-ray emission focal point. The program code means comprise a module for processing the measurement made by a detection means and a control module making it possible to elaborate a control signal for dynamically controlling the position of the focal point relative to a reference position, as a function of a signal supplied by the processing module.

BREIF DESCRIPTION OF THE DRAWINGS

The present invention will be better understood by the detailed description of embodiments taken as nonlimitative examples and illustrated by the attached drawings, in which.

DETAILED DESCRIPTION OF THE INVENTION

Figure 1:
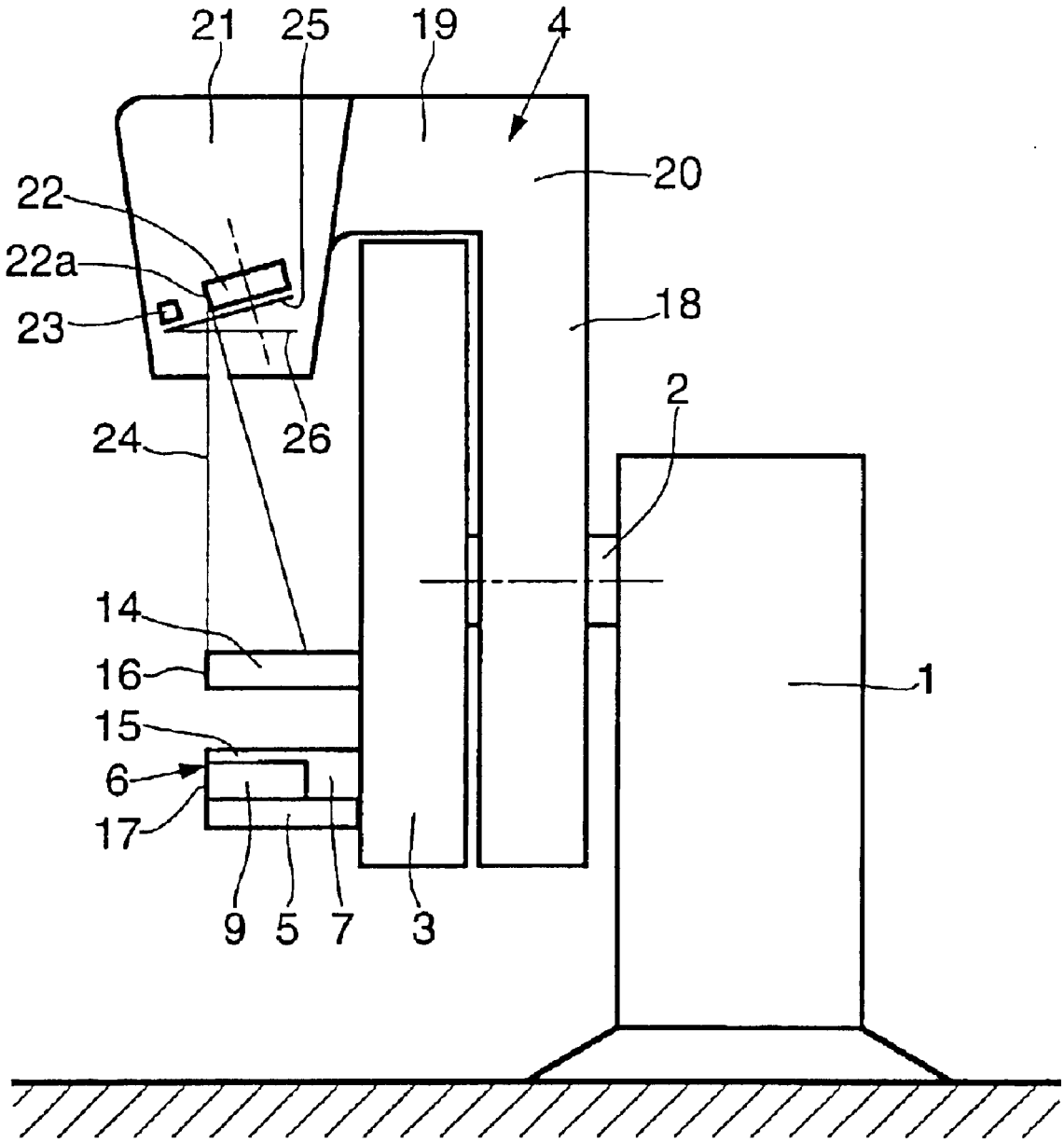
FIG. 1 is a schematic general view of a mammography apparatus.

In FIG. 1, a mammography apparatus comprises a base 1 standing on the floor, supporting through a horizontal axis 2; a fixed vertical support column 3, placed at the end of the axis 2 opposite the base 1; and an assembly 4 rotating on the axis 2. A platform 5 extends horizontally from the column 3, on the side opposite the base 1, and serves as a support for an assembly 6 comprising a flat support member 7 extending in a horizontal plane and resting on the platform 5.

A receiver 9 is placed in the plane of the support member 7 horizontally at the end of the support member 7 opposite the support column 3. A compression member 14 attached to the support column 3, movable vertically relative to the support column 3, extends horizontally from the support column 3 in an area situated vertically facing a fixed surface 15 of the support 7 located above the receiver 9. The end 16 of the compression member 14 opposite member 11 is situated vertically roughly at the same level as an end 17 of the support member 7 horizontally on the opposite side of the base 1.

The generally L-shaped moving assembly 4 comprises a first arm 18 freely rotating on the axis 2 and axially arranged on the axis 2 between the support column 3 and the base 1. A second arm 19 extends perpendicular from one end 20 of the first arm 18, so that the segment 18 can pivot on the axis 2 without the rotation of the arm 19 being disturbed by the support column 3. At its end opposite end 20, the arm 19 supports an X-ray tube 21 including an anode 22 and a cathode 23. The roughly cylindrical anode 22 is placed rotating on an axis possessing a nonzero angle with the vertical. The cathode 23 is placed radially facing a roughly cylindrical surface of revolution of the anode. The cathode 23 is situated facing the focal point 22*a* of the anode, which is situated at the vertical of the end 17 of the support member 7. A filter 25 and a collimator 26 are placed between the anode/cathode assembly 22, 23 and the receiver 9.

In operation, the X-ray tube 21 produces an X-ray beam 24 which crosses the filter 25, the collimator 26, the compression member 14 and then finally an organ to be studied, nor represented, before reaching the receiver 9. The receiver 9 emits on output an image representative of the photons received and depending on the characteristics of the beam emitted by the emitter, of the filter 25, of the organ to be studied and of the emitter itself. Upon the study of a breast, a patient is positioned at the end 16 of the assembly 6, in order to place a breast between the fixed surface 15 and the compression member 14. The vertical position of the compression member 14 is adjusted, so as to press the breast between the compression member 14 and the fixed surface 15. The pressure should be sufficient to keep the breast immobilized during the recording of X-ray films. The inclination of the anode 22 and the collimator 26 make it possible to obtain an X-ray beam 24 not going beyond the vertical plane perpendicular to the figure and passing the end 17 of the support 7 on the side opposite the column 1, in order to irradiate only the patient's breast, without irradiating her thorax.

Figure 2:
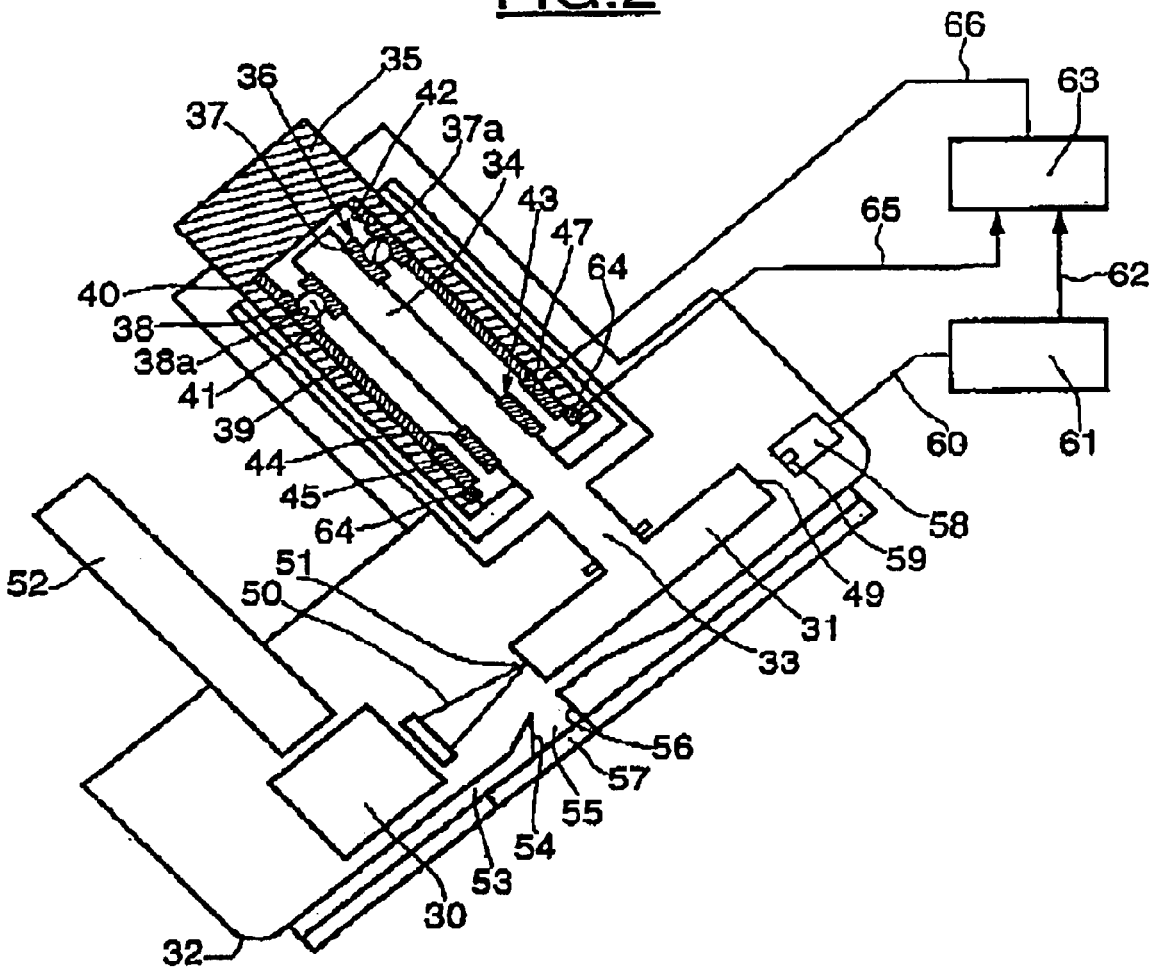
FIG. 2 is a schematic view of an X-ray tube according to one aspect of the invention.
Figure 3:
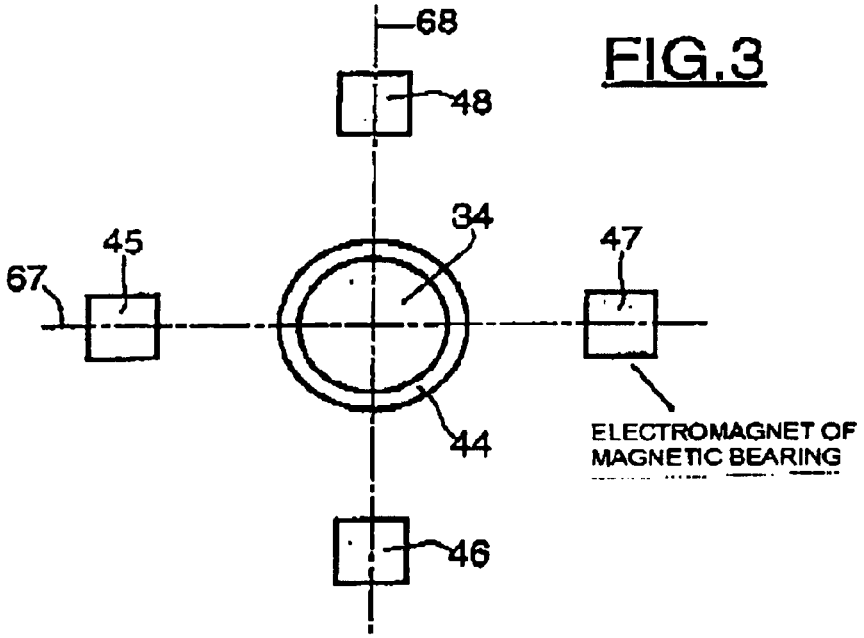
FIG. 3 is an axial view of a magnetic roller bearing.

In FIGS. 2 and 3, an X-ray emission device comprises a cathode 30 and a cylindrical anode 31 contained in a tight envelope 32, making it possible to maintain a partial vacuum. The anode 31 is attached on the axial end 33 of a shaft 34 driven in rotation by means of an electric motor not represented in the figures, in order to improve the clarity of the drawing. The shaft 34 is rotary-mounted on a support 35 by means of a roller bearing 36 comprising an inner ring 37 and an outer ring 38, the inner ring 37 and outer ring 38 being provided with toric raceways 37*a*, 38*a*. Rolling members 41 are placed between the raceways 37*a* and 38*a* of the inner ring 37 and outer ring 38, respectively. The bearing 36 is fixed on the shaft 34 axially on the opposite side of the anode 31. The outer ring 38 of the bearing 36 is inserted in a bore 42 of the support 35. The bearing 36 is axially held in the bore 42 by means of sleeves 39 and 40.

The bearing 36 is adapted to make possible a degree of rotation of the shaft 34 along at least one axis passing through the center of the bearing 36 and perpendicular to the axis of rotation of the anode 31, particularly the axis perpendicular to the radial direction passing through the center of the anode 31 and through the cathode 30.

The shaft 34 is also rotary-mounted on the support 35 by means of a magnetic bearing 43 situated axially between the roller bearing 36 and the anode 31.

The magnetic bearing 43 comprises a magnetic crown 44 inserted on the shaft 34 and electromagnets 45, 46, 47, 48 arranged radially opposite the magnetic crown 44 on the bore 42 of the support 35, circumferentially evenly spaced.

The cathode 30 is radially situated opposite the outer surface of revolution 49 of the anode 31, which is cylindrical here. The cathode 30 produces a beam of electrons 50 received by a portion of the surface of revolution 49 of the anode 31 radially situated opposite the cathode 30, which is called focal point 51. In order to obtain a high-energy beam of electrons, the electrons are accelerated by an intense electric field produced between the cathode 30 and the anode 31. The potential ranges are approximately between 10 and 50 kV and can exceed 150 kV in some cases. Power supply means 52 make it possible to feed energy to the cathode.

The energy brought by the beam of electrons 50 to the focal point 51 is largely converted into heat. A part of the energy is emitted by the focal point 51 in the form of X-rays. A collimator 53 makes it possible to delimit the X-ray beam being directed to the organ to be studied. The collimator 53 includes a wall 54 in a vertical plane and delimiting a first end of the aperture 55 of the collimator 53. A second wall 56, opposite wall 54, delimits the aperture 55. The wall 56 is situated in a plane parallel to the axis of rotation of the anode passing through the focal point 51. A filter 57, made of beryllium, for example, is placed in front of the aperture 55 of the collimator 53 between the focal point 51 and the organ to be studied. The filter 57 is adapted to the receiver 9, with a view to obtaining a better radiographic image. The filter 57 allows passage of X-rays possessing an energy coming within a certain range.

To avoid an increase of temperature of the surface of the anode 31, which could damage the anode, the anode 31 is driven in rotation around the shaft 34. The cylindrical surface 49 of the anode 31 thus rotates past the cathode 30.

A means for detection 58 placed radially opposite the outer surface of revolution of the anode 31 is diametrically opposite the focal point 51. The means for detection 58 comprises a detection element making it possible to measure the distance between the detection element 59 and the cylindrical surface 49 of the anode 31. The measurement of the distance between the detection element 59 and the cylindrical surface 49 of the anode 31 is transmitted by means for connection 60 to a processing module 61 which determines from that measurement the position of the focal point 51 diametrically opposite the detection element 59.

The processing module 61 determines the position of the focal point 51 in relation to a reference position. The module 61 transmits the information on the position of the focal point 51 relative to a reference position by means of a connection 62 to a control module 63 receiving information from an organ of detection 64 placed on the magnetic bearing 43 by means for connection 65 and information transmitted by the module 61 in order to elaborate control signals transmitted to the magnetic bearing 43. The control module 63 is capable of transmitting instructions to the magnetic bearing by means of a link 66.

The detection means 64 placed on the magnetic bearing 43 make it possible to determine the position of the shaft 34 in the magnetic bearing 43. The detection means 64 can include a means of indexing of the rotating shaft 34 in order to ascertain the angular position of the anode 31.

The magnetic bearing 43 comprising four electromagnets 45, 46, 47, 48, which are evenly spaced circumferentially, makes it possible to control the position of the shaft 34 along two perpendicular radial axes 67 and 68, axis 67 being an axis parallel to the radial axis passing through the axis of rotation of the anode 31 and the cathode 30. Thus, one can use the electromagnets arranged on axis 68 to keep the shaft 34 in position, while the electromagnets placed on axis 67 are used to change the position of the shaft 34, so that the focal point 51 remains as close as possible to the reference position. The bearing 36 allowing a degree of rotation of the shaft 34 relative to an axis parallel to the axis 68 passing through the center of the bearing 36 makes possible a modification of the radial position of the shaft 34 at the magnetic bearing 43, along axis 67, and a modification of the radial position of the anode 31.

It is desirable to control the position of the focal point 51 relative to the reference position along the axis passing through the axis of rotation of the anode 31 and cathode 30. In fact, only the variations of position of the focal point 51 in a radial plane and, in particular, along the axis of the radial plane passing though the axis of rotation of the anode 31 and the cathode 30 entail an appreciable change of size of the apparent X-ray source. An axial variation of the position of the anode 31 does not entail any significant variation of position of the focal point 51 relative to the reference position.

The processing module 61 can include a stage of amplification of the signal received from the detection element 59 and a comparison stage relative to a reference value. The processing module 61 and the control module 63 can be integrated in a computer program including means for employing the processing and control functions.

The control module 63 receives information on the position of the focal point 51 of the anode 31 from the processing module 61 and information on the position of the shaft 34 from the detection means 64, and then supplies instructions to the magnetic bearing 43 from this information, in order to keep the focal point 51 close to its reference position.

The means for detection 58, the processing module 61, the control module 63, the magnetic bearing 43 and the means for detection 64 form a means for dynamic control of the position of the focal point 51 of the anode 31. The control module 63, the magnetic bearing 43 and the means for detection 64 form a means for control of the position of the rotary shaft 34 of the anode 31.

As the anode 31 possesses an imperfectly cylindrical outer surface 49, measurement of the distance between the detection element 59 and the surface portion radially opposite the focal point 51 supplies only partial information on the real position of the focal point 51. Knowledge of the angular orientation of the anode 31, supplied, for example, by means for detection 64 including angular indexing or by any other appropriate means, combined with knowledge by the processing module 61 of the profile of the anode, acquired, for example, during mounting of the X-ray emission device, makes it possible to locate the position of the focal point 51 precisely from measurement of the detection element 59. The means for detection 64 can supply angular orientation information direct to the processing module 61 or to the control module 63. Module 61 makes it possible to determine the position of the focal point 51 in spite of a possible expansion of the anode 31 on use of the X-ray emission device.

The X-ray emission device can include means for processing comprising a microprocessor, a memory, a communication bus and ports. The processing module 61 and the control module 63 can be software modules registered in the memory of a microprocessor and active if executed by the microprocessor.

Figure 4:
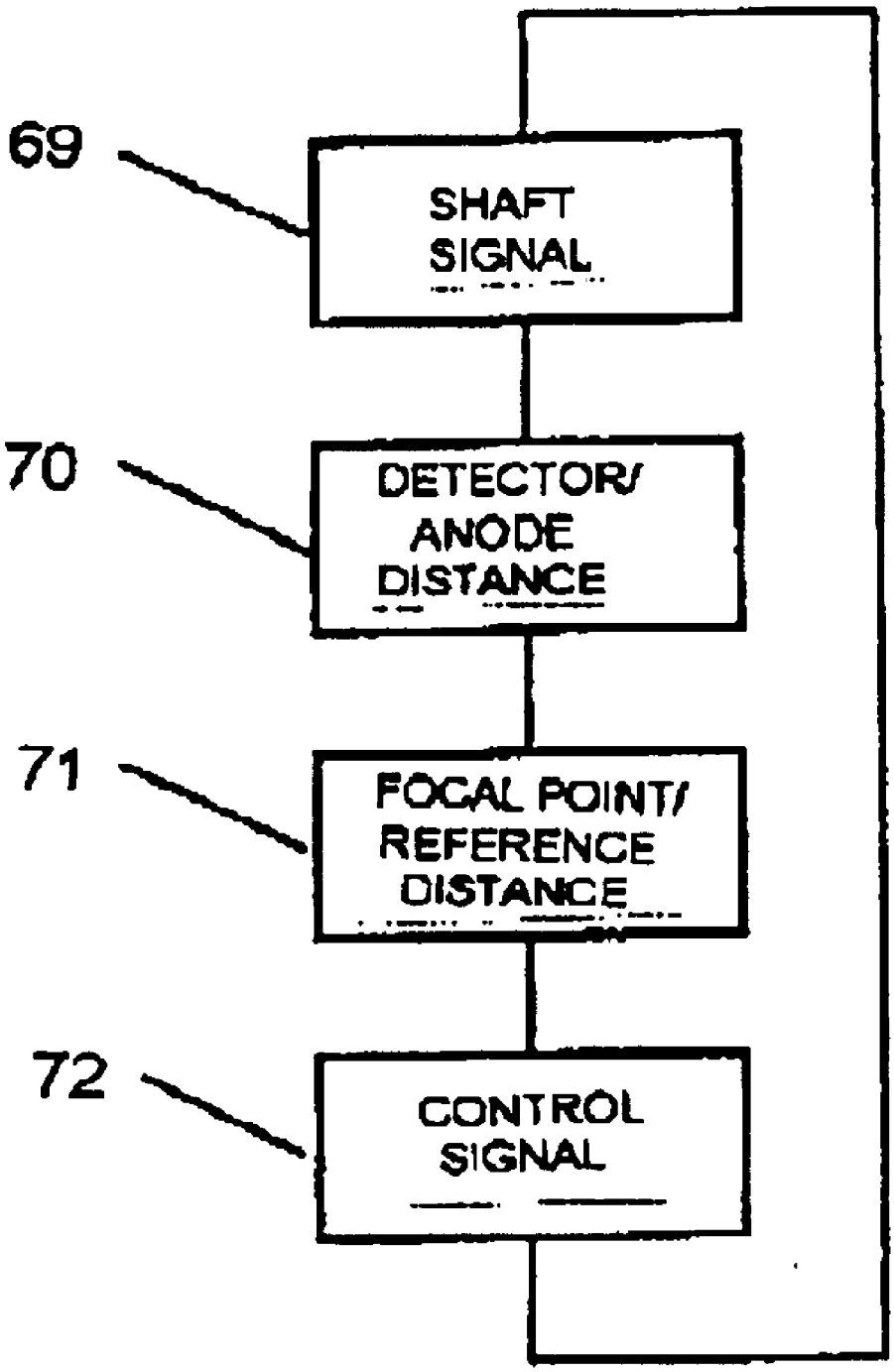
FIG. 4 is a block diagram representing the principal stages of a computer program making possible the use of the tube according to FIG. 3.

In FIG. 4, a block diagram represents the different stages of a computer program including program code means making use of the X-ray emission device possible.

In stage 69, the signal supplied by the means for detection 64 is integrated, in order to deduce, through a control module 63, the radial position of the shaft 34 and/or the angular position of the shaft 34. In stage 70, the signal supplied by the means for detection 58 is integrated in order to deduce the distance between the detection element 59 and the surface of the anode 49 through a processing module 61. In stage 71, the processing module 61 calculates the distance between the focal point and a reference position. In stage 72, the means for control 63 elaborates a control signal from the position of the shaft 34 and from the position of the focal point 51 relative to the reference position, to control the position of the shaft 34, so that the focal point will be as close as possible to its reference position. The program then resumes in stage 69 in order to carry out a dynamic control of the position of the focal point 51.

The X-ray emission device therefore makes it possible to control dynamically the position of the focal point of the anode relative to a reference position, in order to obtain an apparent X-ray emission source of small dimensions, making it possible to obtain a better space resolution of the focal point, which helps to increase the contrast on radiographic images made from an X-ray beam emitted by the X-ray emission device. A better space resolution makes it possible, for example, to detect smaller microcalcifications.

Thus, the dynamic control of the position of the focal point of the anode relative to a reference position makes it possible to obtain an apparent X-ray source of reduced dimensions enabling radiographic images possessing an excellent resolution to be obtained.

According to one aspect of the invention, the means for control include means for control of the position of the focal point in a radial plane. As the surface on which the X-ray emission focal point is formed is roughly cylindrical, a displacement of the position of the focal point in a radial plane produces a considerable variation of the dimensions of the apparent X-ray emission source. A variation of the position of the focal point along a longitudinal axis has less of an influence. It is therefore desirable to control the position of the focal point in a radial plane.

The means for control includes means for control of the distance between the focal point and the cathode. As the cathode of the X-ray tube is fixed, control of the distance between the focal point and the cathode permits controlling the position of the focal point of the anode relative to a reference position.

The X-ray emission device may include means for detection of the position of the focal point of the anode. The means for detection of the position of the focal point of the anode makes it possible to obtain information that will be used by the means for control of the position of the focal point for controlling the position of the focal point relative to a reference position.

The means for detection may include means for measurement of radial distance between an organ of detection and the roughly cylindrical surface of the anode.

The means for detection of the position of the focal point may be radially distant from the focal point of the anode. The radially distant placement of the means for detection of the position of the focal point relative to the focal point makes it possible to measure the radial distance between the focal point and the cathode, while keeping the means for detection far away from the beam of electrons bombarding the roughly cylindrical surface of the anode.

In an embodiment, the means for detection of the position of the focal point is placed diametrically opposite the focal point of the anode. That particular arrangement of the means for detection, measuring a distance between the organ of detection and the roughly cylindrical surface of the anode, makes it possible to directly determine the position of the focal point of the anode relative to a reference position, in a radial plane and along a radial axis passing through the focal point and through the cathode.

In one embodiment, the X-ray emission device includes means for controlling the position of the anode. Control of the position of the anode makes it possible to act on the position of the anode in a radial plane and, therefore, the position of the focal point in a radial plane, in order to control the radial distance between the cathode and the focal point of the anode. The means for control is active on the position of the focal point in a radial plane.

In one embodiment, the anode is rotary-mounted on a support by means of a magnetic bearing. The use of a magnetic bearing makes it possible to control the position in a radial plane of an axis of rotation connected to the support by a magnetic bearing, with a view to control of the position of the anode. The magnetic bearing makes it possible to alter the position of the anode along a first radial plane, maintaining the position of the anode along a second radial axis perpendicular to the first radial axis. The radial axis passing through the focal point and through the cathode will advantageously be chosen as radial axis along which the position of the anode can be altered, in order to control the distance between the focal point and the cathode.

The X-ray emission device may include means for control of the magnetic bearing. The means for control of the magnetic bearing can include a position detector of a shaft mounted in the magnetic bearing and a module for processing data supplied by the detection means making it possible to determine the position of the focal point of the anode.

The X-ray emission device may include means for angular indexing of the anode relative to the support. Angular indexing of the anode relative to the support makes it possible to determine the radial distance between a reference position and the focal point of the anode, by measuring the position of the anode at a different point of the focal point, notably, in case the anode is not strictly circular.

An embodiment of the invention is also directed to a method of X-ray emission in a device comprising a cathode and a rotating anode, the anode being provided with a roughly cylindrical surface and the device being capable of forming a beam of electrons that bombard a portion of the roughly cylindrical surface of the anode constituting the X-ray emission focal point, in which the position of the focal point of the anode is dynamically controlled relative to a reference position.

Various modifications in structure and/or steps and/or function and equivalents thereof may be made by one skilled in the art without departing from the scope and extent of protection as recited in the claims.

What is claimed is:

1. A radiation emission device comprising:

a cathode;

a rotating anode;

the anode being provided with a cylindrical surface of revolution;

the device being capable of forming a beam of electrons that bombards a portion of the cylindrical surface of the anode, wherein the beam of electrons at the surface constitutes the focal point of emission of the radiation to define a focal point of the anode, wherein the cathode is disposed radially facing the cylindrical surface of revolution of the anode beam; and means for dynamically controlling the position of the focal point of the anode relative to a reference position.

2. The device according to claim 1 wherein the means for dynamically controlling comprises means for control of the position of the focal point of the anode in a radial plane.

3. The device according to claim 1 wherein the means for dynamically controlling include means for control of the distance between the focal point of the anode and the cathode.

4. The device according to claim 2 wherein the means for dynamically controlling include means for control of the distance between the focal point of the anode and the cathode.

5. The device according to claim 1 comprising:

means for determining the position of the focal point of the anode.

6. The device according to claim 5 wherein the means for determining comprises a means for measurement of a radial distance between a means for detection and the surface of the anode.

7. The device according to claim 6 wherein the means for detection is radially distant from the focal point of the anode.

8. The device according to claim 6 wherein the means for detection is placed diametrically opposite the focal point of the anode.

9. The device according to claim 1 comprising means for controlling the position of the anode.

10. The device according to claim 9 wherein the means for controlling the position the anode comprises means for controlling the position of the anode along a first radial axis, while maintaining the position of the anode along a second radial axis perpendicular to the first radial axis.

11. The device according to claim 1 wherein the anode is rotary-mounted on a support by means of a magnetic bearing.

12. The device according to claim 11 comprising means for control of the magnetic bearing.

13. The device according to claim 1 comprising means for angular indexing of the anode in relation to a support.

14. A method of radiation emission in a device comprising a cathode and a rotating anode, the anode being provided with a cylindrical surface of revolution and the device forming a beam of electrons that bombards a portion of the cylindrical surface of the anode, wherein the beam of electrons at the surface constitutes the focal point emission of the radiation to define a focal point of the anode, wherein the cathode is disposed radially facing the cylindrical surface of revolution of the anode, in which the position of the focal point of the anode is controlled relative to a reference position.

15. An article of manufacture comprising:

a computer usable medium having computer readable program code means embodied therein for causing dynamic control of the position of a focal point of an anode in a radiation emission device having a cathode that produces a beam of electrons, the focal point of the anode being defined by the focal point of the beam of electrons at a cylindrical surface of revolution of the anode wherein the cathode radially faces the cylindrical surface, comprising:

a computer readable program code means for causing a computer to determine the focal point of the anode; and a computer readable program control means for causing a computer to elaborate a control signal for dynamically controlling the position of the focal point of the anode relative to a reference position as a function of a signal provided by the determination of the focal point of the anode.

16. A program storage device readable by a machine, tangibly embodying a program of instructions executable by the machine to perform method steps for dynamically controlling a position of a focal point of an anode in a radiation emission device having a cathode that produces a beam of electrons, the focal point of the anode being defined by the focal point of the beam of electrons at a cylindrical surface of revolution of the anode wherein the cathode radially faces the cylindrical surface, the method steps comprising:

detecting a signal for the angular index of the anode relative to a support;

determining the position of the focal point of the anode;

calculating the distance between the focal point of the anode and a reference position; and elaborating a control signal from the position of the support and from the position of the focal point of the anode relative to the reference position.

* * * * *

UNITED STATES PATENT AND TRADEMARK OFFICE

CERTIFICATE OF CORRECTION

PATENT NO. : 6,879,662 B2
APPLICATION NO. : 10/218827
DATED : April 12, 2005
INVENTOR(S) : Blin et al.

It is certified that error appears in the above-identified patent and that said Letters Patent is hereby corrected as shown below:

Column 2:
Line 41, after "a" insert therefor -- concerns --
Line 64, after "that" delete "bombard" and insert therefor -- bombards --

Column 3:
Line 6, delete "BREIF" and insert therefor -- BRIEF --
Line 18, after "FIG." delete "3" and insert therefor -- 2 --
Line 61, before "represented" delete "nor" and insert therefor -- not --

Column 4:
Line 9, after "the" (third occurrence) delete "column" and insert therefor -- base --

Column 5:
Line 54, after "passing" delete "though" and insert therefor -- through --

Column 6:
Line 46, after "anode" delete "49" and insert therefor -- 31 --

Column 8:
Line 40, after "anode" delete "beam"

Column 9:
Line 2, after "position" insert therefor -- of --
Line 18, after "point" insert therefor -- of --

Signed and Sealed this

Eighth Day of January, 2008

JON W. DUDAS
*Director of the United States Patent and Trademark Office*